US006227186B1

(12) United States Patent
Seidl et al.

(10) Patent No.: US 6,227,186 B1
(45) Date of Patent: May 8, 2001

(54) IGNITION SYSTEM FOR AN INTERNAL COMBUSTION ENGINE

(75) Inventors: Reinhard Seidl, Sonthofen; Christian Bonnefoit, Martinszell, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/431,984

(22) Filed: Nov. 2, 1999

(30) Foreign Application Priority Data

Nov. 27, 1998 (DE) ..... 298 21 239 U

(51) Int. Cl.[7] ..... F02P 11/00
(52) U.S. Cl. ..... 123/634; 123/635
(58) Field of Search ..... 123/634, 635, 123/195 C

(56) References Cited

U.S. PATENT DOCUMENTS 5,261,381 * 11/1993 Sugiura et al. ..... 123/634
5,462,023 * 10/1995 Furuya ..... 123/143 C
5,628,298 * 5/1997 Murata ..... 123/635
5,771,870 * 6/1998 Satou et al. ..... 123/635
5,842,458 * 12/1998 Alstrin et al. ..... 123/635
5,870,012 * 2/1999 Sakamaki et al. ..... 123/634

FOREIGN PATENT DOCUMENTS 39 20 080 1/1991 (DE) .

* cited by examiner

*Primary Examiner*—Erick Solis
(74) *Attorney, Agent, or Firm*—Kenyon & Kenyon

(57) ABSTRACT

An ignition system for an internal combustion engine is able to operate without malfunctions, even under unfavorable surrounding conditions, in particular intensive attack by spray water. To that end, the ignition system, projecting into a compartment of a cylinder head, is provided with a protective covering in which are formed a connecting duct that is connected to the compartment, and a vent duct leading into the atmosphere. Both ducts are interconnected by a storage of the ignition coil. Water penetrating into the ignition coil is caught in the storage and evaporated in such a way that no malfunctions occur at the ignition coil. The ignition system is preferably used in manufacturing automobiles.

7 Claims, 1 Drawing Sheet

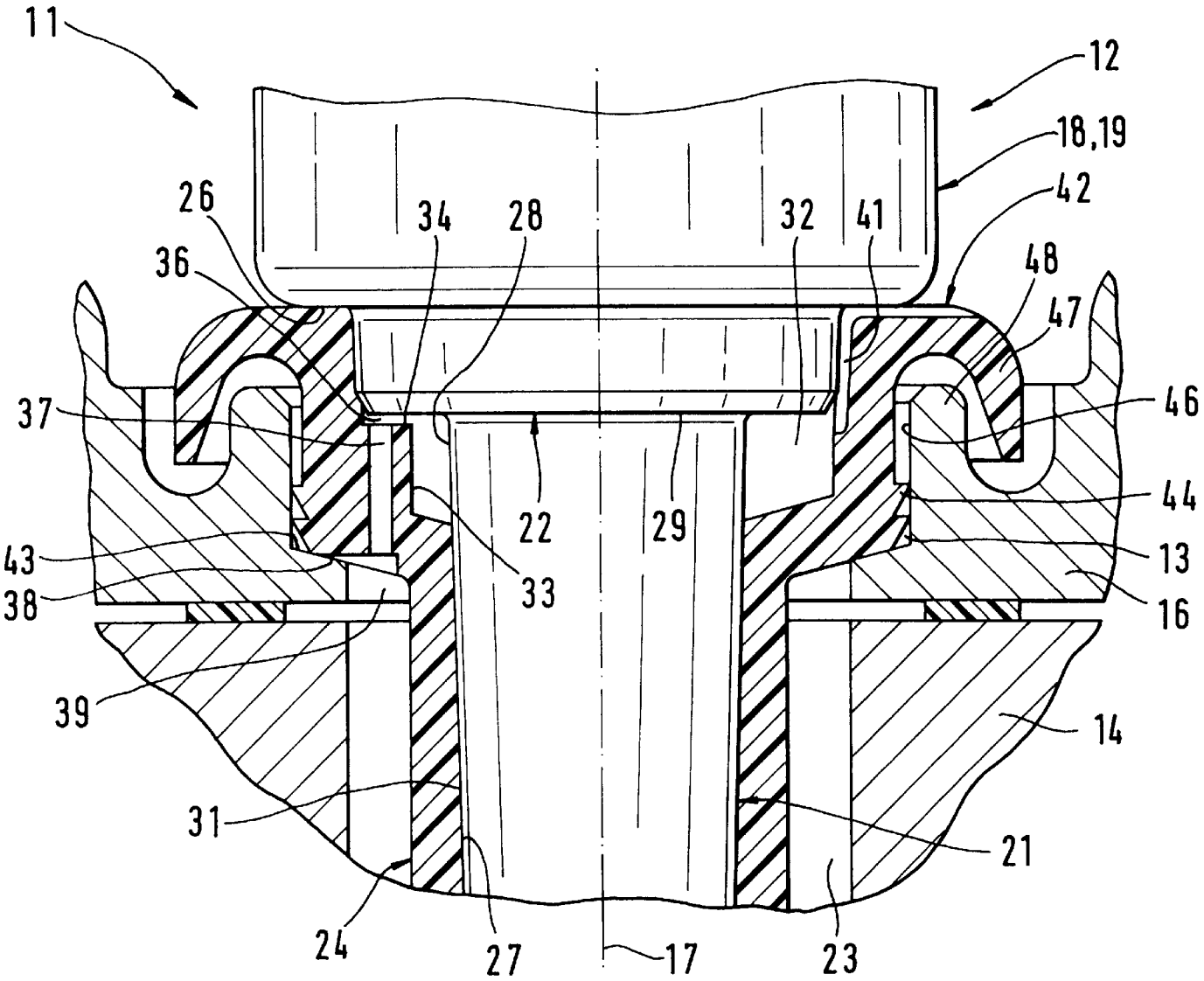
12
18,19
42
48
47
46
44
13
16
14
21
23
41
32
29
17
28
22
33
27
34
24
26
36
31
11
37
43
38
39

IGNITION SYSTEM FOR AN INTERNAL COMBUSTION ENGINE

BACKGROUND INFORMATION

German Patent No. 39 20 080 described an ignition system for an internal combustion engine in which a spark plug is inserted into a spark-plug compartment (well) of a cylinder head of the internal combustion engine.

A cylinder-head cover is placed on the cylinder head, with the interposition of a gasket. Above the spark-plug compartment, the cylinder-head cover has an installation opening into which is inserted an ignition coil that is connected to the spark plug by way of a connecting plug.

If spray water, e.g. from a high-pressure cleaner, acts upon the ignition coil, this water can get through the installation gap into the installation opening, and from there into the spark-plug compartment. This can occur in particular when the cylinder head is heated to above 100° C. due to the operation of the internal combustion engine, and, during the standstill phase of the internal combustion engine, is cooled off to the ambient temperature. In so doing, the air volume in the spark-plug compartment and the installation opening contracts; an underpressure develops which evens out due to advancing air and moisture along the contact area of the ignition coil. The moisture thus introduced forms a liquid pool around the spark plug, and can impair the high-voltage transmission of the ignition coil, which can result in malfunctions of the ignition system.

SUMMARY OF THE INVENTION

In contrast, the ignition system of the present invention for an internal combustion engine has the advantage that the above-mentioned shortcoming is avoided to a satisfactory degree.

To that end, in the ignition system, the ignition coil is inserted, in a sealed manner, into the installation opening of the cylinder-head cover, thus preventing the entrance of water along the installation opening. In addition, the compartment having the spark plug is vented via a ventilating system of the ignition coil, so that no underpressure can occur any longer in the compartment when the internal combustion engine cools off, and thus there is no suction effect on the water present at the ignition coil.

Water, which because of unfavorable conditions such as the direct blasting of the ignition coil with a high-pressure cleaner, finds a way in small quantities through the ventilation system, is collected in a storage device of the ventilation system, and with the heating of the internal combustion engine during its operation, is evaporated and released.

In this manner, a particularly operationally-reliable ignition system is implemented.

BRIEF DESCRIPTION OF THE DRAWING

The FIGURE shows parts of the ignition system according to the present invention in a sectional view.

DETAILED DESCRIPTION

As shown in the FIGURE, an ignition system 11 of an internal combustion engine for contacting a spark plug fixedly mounted in the internal combustion engine contains, as an important component, an ignition coil 12 which is inserted in a sealed manner in an installation opening 13 of a cylinder-head cover 16 that is likewise placed in a sealed manner on a cylinder head 14 of the internal combustion engine.

As shown in the FIGURE, in the operating position of the internal combustion engine, lid-shaped cylinder-head cover 16 is horizontally aligned, and bar-type ignition coil 12 is arranged running vertically along a longitudinal axis 17 in the fitting position.

Starting from this fitting position of ignition coil 12, the ignition coil 12 with a housing 18 and in co-axial arrangement with respect to longitudinal axis 17, has a partially shown, basically cylindrical housing upper part 19, a sleeve-shaped lower-lying dome 21 whose diameter is reduced with respect to housing upper part 19, and a cylindrical sealing band 22, mounted between housing upper part 19 and dome 21, whose diameter is between that of housing upper part 19 and that of dome 21.

While housing upper part 19 is arranged above cylinder-head cover 16 when ignition coil 12 is mounted, sealing band 22 projects region-wise into installation opening 13 of cylinder-head cover 16. Dome 21 runs partially in installation opening 13 and projects with its free end section into a compartment 23 of cylinder head 14 for contacting ignition coil 12 with the spark plug, supported here in a recessed and stationary manner.

Externally in the region of sealing band 22 and dome 21, ignition coil 12 has a protective covering 24 which, in a manner not shown more precisely, extends beyond the free end of dome 21 and partially overlaps the spark plug. Protective covering 24 is an elastomeric machined part, made preferably of silicone rubber, and is provided as a sleeve member having a through-passage.

Before ignition coil 12 is mounted on the internal combustion engine, protective covering 24 is slid from the free end of dome 21 onto the dome and sealing band 22, until it strikes at the front side against a shoulder 26 that is formed on the face on housing upper part 19 at the transition to sealing band 22. Due to the vertical extension of sealing band 22, tolerances of the end position of protective covering 24 owing to the sliding-on process are of no importance to the sealing of ignition coil 12.

Protective covering 24 has a largely constant wall thickness over long areas in its vertical extension, so that its shape here is in relation to that of dome 21 and sealing band 22, and it surrounds sealing band 22 and dome 21 here with an inner side 27 in a resilient, and thus sealing manner.

However, at one end section 28 of dome 21 adjacent to sealing band 22, protective covering 24 is set back in a graduated manner from dome 21, so that formed between an end face 29 of sealing band 22 adjacent to dome 21, an outer side 31 of dome 21 and inner side 27 of protective covering 24, is an interspace which is designated as a storage 32 in accordance with its function. The vertical extension of storage 32 corresponds approximately to that of sealing band 22.

Storage 32 is bounded at one location by a radially projecting semi-cylindrical inner shoulder 33 of inner side 27 of protective covering 24, the vertical extension of inner shoulder 33 being less than that of storage 32, so that between end face 29 of sealing band 22 and a boundary surface 34 of inner shoulder 33 opposite end face 29, there remains a horizontally running gap 36 which opens through into storage 32.

A connecting duct 37 runs vertically aligned in inner shoulder 33 between gap 36 and a limit stop 38 mounted outside on protective covering 24, there being a direct connection from connecting duct 37 to compartment 23 via an adjoining recess 39 of cylinder head cover 16.

Formed opposite inner shoulder 33, in protective covering 24, is a grooved, narrow vent duct 41, designed for the escape of air bubbles, which begins approximately at the same height as boundary surface 34 of inner shoulder 33, is directly connected here to storage 32, then runs vertically along sealing band 22 in order, at its end, to run along shoulder 26 of housing upper part 19 in a radial course beyond shoulder 26, and opens through into the open surrounding space of ignition coil 12.

Thus, with vent duct 41, storage 32 and connecting duct 37, a ventilation system 42 of ignition coil 12 is provided, via which, with the aid of recess 39 provided on cylinder-head cover 16, compartment 23 is connected to the surrounding space of ignition coil 12 and thus can be vented into the atmosphere.

With the insertion of ignition coil 12, provided with protective covering 24, into installation opening 13, protective covering 24 with limit stop 38 makes contact with a contact area 43 of cylinder-head cover 16; and circumferential, externally-radially projecting sealing rings 44 of protective covering 24 come in contact with an inner wall 46 of installation opening 13. The axially displaced sealing rings 44 have slightly different diameters, in order to compensate for tolerances in installation opening 13.

To further seal off installation opening 13, protective covering 24 has, in radial extension at its free end section on the ignition-coil side, a curvilinier circumferential collar 47 which overlaps an allocated sealing shoulder 48 of cylinder head cover 16 and shields sealing rings 44 from being directly acted upon by spray water.

If an ignition system 11, designed in such a manner, is struck intensively by spray water, such as when washing the engine by a high-pressure cleaner, it is impossible to completely prevent water from entering into ignition coil 12 through narrow vent duct 41. This small amount of seepage water, at the end of vent duct 41 situated in ignition coil 12, gets into adjoining storage 32 whose size is dimensioned such that this seepage water fills storage 32 only to a small degree in the lower region. Because the ends of connecting duct 37 and of vent duct 41 open through overhead into storage 32, it is ensured that, first of all, no water can get from storage 32 via connecting duct 37 to compartment 23, and secondly, the air connection passing through from compartment 23 to the atmosphere is not blocked by the seepage water.

The seepage water in storage 32 can be removed through this air connection by evaporation. This process is further supported by heating of the internal combustion engine during operation.

What is claimed is:

1. An ignition system of an internal combustion engine, the engine including a cylinder head and a cylinder-head cover situated in a sealing manner on the cylinder head, the cylinder head having a compartment, the cylinder-head cover having an installation opening, the ignition system comprising:

an ignition coil at least partially supported in the installation opening and supported in a sealing manner in the installation opening, the ignition coil projecting section-wise into the compartment, the ignition coil including a ventilation system for venting the compartment, the ventilation system having a storage.

2. The ignition system according to claim 1, wherein the ventilation system has at least one connecting duct connected to the compartment and the storage.

3. The ignition system according to claim 1, wherein the ventilation system has at least one vent duct connected to the storage and to a surrounding space of the ignition coil.

4. The ignition system according to claim 1, wherein the ventilation system has at least one connecting duct and at least one vent duct opening through, set apart from each other, into the storage.

5. The ignition system according to claim 4, wherein the at least one connecting duct and the at least one vent duct open through overhead into the storage, relative to a fitting position of the ignition coil with a vertically aligned longitudinal axis of the ignition coil.

6. The ignition system according to claim 1, wherein the ignition coil further includes a housing having a sealing band, a dome adjoining the sealing band, and an elastomeric protective covering surrounding the sealing band and the dome with a pre-loading, the storage being bounded by the sealing band, the dome and the protective covering.

7. The ignition system according to claim 6, wherein an outside of the protective covering has sealing rings of differing diameters for sealing with respect to the installation opening, the protective covering overlapping a sealing shoulder of the cylinder-head cover via a circumferential collar.

* * * * *